US010227729B2

(12) United States Patent
Mohammadi et al.

(10) Patent No.: US 10,227,729 B2
(45) Date of Patent: Mar. 12, 2019

(54) PROCESSES FOR EXTRACTING TRICHOMES FROM PLANTS AND FIBROUS STRUCTURES EMPLOYING SAME

(71) Applicant: The Procter & Gamble Company, Cincinnati, OH (US)

(72) Inventors: Khosrow Parviz Mohammadi, Liberty Township, OH (US); Stephen Robert Glassmeyer, Cincinnati, OH (US); Raul Victorino Nunes, Loveland, OH (US); Joseph Edwin Gilliland, West Manchester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/963,278

(22) Filed: Dec. 9, 2015

(65) Prior Publication Data

US 2016/0160439 A1 Jun. 9, 2016

Related U.S. Application Data

(60) Provisional application No. 62/089,365, filed on Dec. 9, 2014.

(51) Int. Cl.

| | |
|---|---|
| ***D21B 1/02*** | (2006.01) |
| ***D21B 1/06*** | (2006.01) |
| ***D21H 13/10*** | (2006.01) |
| ***D21H 27/02*** | (2006.01) |
| ***D21H 27/30*** | (2006.01) |
| ***D21F 11/00*** | (2006.01) |
| ***D21H 27/00*** | (2006.01) |
| ***D21H 11/12*** | (2006.01) |

(52) U.S. Cl.

CPC ..... *D21H 13/10* (2013.01); *D21B 1/06* (2013.01); *D21F 11/00* (2013.01); *D21H 11/12* (2013.01); *D21H 27/002* (2013.01); *D21H 27/02* (2013.01); *D21H 27/30* (2013.01)

(58) Field of Classification Search

USPC .... 162/13, 99, 109, 123, 141, 148.149, 183, 162/185; 209/24.1, 24.12, 24.19, 24.21, 209/27–30; 241/1, 12.1

See application file for complete search history.

(56) References Cited

U.S. PATENT DOCUMENTS

| | | | | |
|---|---|---|---|---|
| 3,994,771 | A * | 11/1976 | Morgan, Jr. ..... | D21F 11/006 162/113 |
| 7,691,472 | B2 | 4/2010 | Vinson et al. | |
| 7,811,613 | B2 | 10/2010 | Vinson et al. | |
| 8,029,645 | B2 | 10/2011 | Mohammadi | |
| 8,056,841 | B2 | 11/2011 | Vinson et al. | |

(Continued)

OTHER PUBLICATIONS

Documentation for ImageJ software, National Institute of Health, 3 pages, 2007, [online], retrieved from the Internet, [retrieved Jan. 8, 2017], <URL: https://imagej.nih.gov/ij/index.html>.*

(Continued)

*Primary Examiner* — Dennis R Cordray
(74) *Attorney, Agent, or Firm* — C. Brant Cook

(57) ABSTRACT

Processes for extracting trichomes from plants and more particularly to processes for extracting trichomes from a mixture of trichome and non-trichome materials using a screen, for example a pressure screen, and fibrous structures employing such extracted trichomes are provided.

10 Claims, 5 Drawing Sheets

(56) References Cited

U.S. PATENT DOCUMENTS

| | | | | |
|---|---|---|---|---|
| 8,297,543 | B2 | 10/2012 | Vinson et al. | |
| 8,425,722 | B2 | 4/2013 | Mohammadi | |
| 8,623,176 | B2 | 1/2014 | Vinson et al. | |
| 8,808,501 | B2 | 8/2014 | Vinson et al. | |
| 9,011,641 | B2 | 4/2015 | Mohammadi et al. | |
| 2009/0054858 | A1 | 2/2009 | Cheng et al. | |
| 2011/0168342 | A1* | 7/2011 | Mohammadi ..... | D21H 11/12 162/146 |
| 2011/0226430 | A1 | 9/2011 | Mohammadi | |
| 2013/0215995 | A1 | 8/2013 | Mohammadi | |
| 2013/0220563 | A1 | 8/2013 | Mohammadi | |
| 2014/0083637 | A1 | 3/2014 | Vinson et al. | |
| 2014/0138040 | A1 | 5/2014 | Sartini et al. | |
| 2014/0141203 | A1 | 5/2014 | Sartini et al. | |
| 2015/0211186 | A1 | 7/2015 | McNeil et al. | |

OTHER PUBLICATIONS

All Office Actions U.S. Appl. No. 14/093,776.
U.S. Appl. No. 14/098,776, filed Dec. 2, 2013, Kenneth Douglas Vinson, et al.

* cited by examiner

PROCESSES FOR EXTRACTING TRICHOMES FROM PLANTS AND FIBROUS STRUCTURES EMPLOYING SAME

FIELD OF THE INVENTION

The present invention relates to processes for extracting trichomes from plants and more particularly to processes for extracting trichomes from a mixture of trichome and non-trichome materials using a screen, for example a pressure screen, such as a slotted pressure screen, and fibrous structures employing such extracted trichomes.

BACKGROUND OF THE INVENTION

The interest in using non-wood materials, such as trichomes and bamboo fibers, to make fibrous structures, for example sanitary tissue products, has recently increased in light of the continuing efforts relating to sustainability.

One non-wood material that shows promise as a replacement or partial replacement of wood pulp fibers in fibrous structures, such as sanitary tissue products, is trichomes; namely, individualized trichomes derived from plants, such as Lamb's Ear plants (*Stachys byzantina*). However, "clean" individualized trichomes are challenging to obtain in large amounts due to the impurities, such as stems, specks, dirt, clay, sand, and other non-trichome materials that are present with the individualized trichomes as a result of the processes for harvesting and extracting the individualized trichomes from the plants. As shown in Prior Art FIG. 1, these impurities find their way into the fibrous structures 10 made with the extracted trichomes and result in the fibrous structures 10 looking dirty and filled with specks that render the fibrous structures 10 unacceptable to consumers of the fibrous structures 10.

The known processes for extracting trichomes from plants typically utilize mechanical cutting and air sorting operations. Such operations are very costly, require high amounts of maintenance, are normally batch processes rather than continuous processes, and the extracted trichomes still contain a level of non-trichome materials, for example specks, sand, stems, that is not consumer acceptable.

Accordingly, one problem with known processes for extracting trichomes from plants is the inability to remove non-trichome materials (impurities present in the plants and/or growing environments from which the plants are harvested) cost effectively and/or in a continuous process such that the extracted trichomes contain no or a consumer acceptable level of non-trichome materials so that the extracted trichomes may ultimately be used to make consumer desirable fibrous structures for sanitary tissue products.

Extracting trichomes to sufficient purity levels (minimizing and/or eliminating the non-trichome materials within the extracted trichomes, for example to be substantially free of (less than 5% and/or less than 4% and/or less than 3% and/or less than 2% and/or less than 1% and/or less than 0.5% and/or about 0% by weight of non-trichome materials) non-trichome materials from trichome-bearing plants at commercial volumes has never been achieved prior to the present invention.

Clearly, there is a need for processes that are able to extract trichomes from plants and/or from a mixture of trichomes and non-trichome materials, such as stems, specks, dirt, clay, sand, in a cost effective, low maintenance, continuous process that results in the extracted trichomes having no or a consumer acceptable level of non-trichome materials (impurities present in the plants and/or growing environments from which the plants are harvested) such that the extracted trichomes can be used to make consumer desirable fibrous structures.

SUMMARY OF THE INVENTION

The present invention fulfills the need described above by providing a process for extracting trichomes from plants that overcomes the negatives associated with known extraction processes for trichomes such that the extracted trichomes may be used to make consumer desirable fibrous structures.

One solution to the problem identified above is to extract the trichomes from a mixture of trichome and non-trichome materials using the processes of the present invention, for example utilizing a screen, such as a pressure screen, such that the extracted trichomes are substantially free of (less than 5% and/or less than 4% and/or less than 3% and/or less than 2% and/or less than 1% and/or less than 0.5% and/or about 0% by weight) non-trichome materials having an average particle size of 0.0001 $cm^2$ or greater as measured according to the Trichomes Purity Test Method described herein. It has unexpectedly been found that such extracted trichomes may be used to make fibrous structures that are consumer acceptable and substantially free of (less than 5% and/or less than 4% and/or less than 3% and/or less than 2% and/or less than 1% and/or less than 0.5% and/or about 0% by weight) non-trichome materials having an average particle size of 0.0001 $cm^2$ or greater as measured according to the Fibrous Structure Purity Test Method described herein.

In one example of the present invention, a process for extracting trichomes from non-trichome materials, the process comprising the steps of:

a. providing a mixture of trichomes and non-trichome materials; and b. separating the trichomes from the non-trichome materials to produce extracted trichomes, wherein the extracted trichomes are substantially free of non-trichome materials having an average particle size of 0.0001 $cm^2$ or greater as measured according to the Trichomes Purity Test Method, is provided.

In another example of the present invention, a plurality of extracted trichomes obtained from a process according to the present invention, is provided.

In another example of the present invention, a process for making a fibrous structure, the process comprising the steps of:

a. providing a fiber furnish comprising extracted trichomes according to the present invention;

b. depositing the fiber on a foraminous forming surface to form an embryonic fibrous web; and c. drying the embryonic fibrous web to form a fibrous structure, is provided.

In still another example of the present invention, a fibrous structure comprising a plurality of extracted trichomes according to the present invention such that the fibrous structure is substantially free of non-trichome materials having an average particle size of 0.0001 $cm^2$ or greater as measured according to the Fibrous Structure Purity Test Method, is provided.

In even another example of the present invention, a fibrous structure comprising a plurality of individualized trichomes and being substantially free of non-trichome materials having an average particle size of 0.0001 $cm^2$ or greater as measured according to the Fibrous Structure Purity Test Method, is provided.

In still yet another example of the present invention, a single or multi-ply sanitary tissue product comprising a fibrous structure according to the present invention is provided.

The present invention provides a process for extracting trichomes from plants that overcomes the negatives of known processes for extracting trichomes from plants, fibrous structures made from such extracted trichomes, and processes for making such fibrous structures.

DETAILED DESCRIPTION OF THE INVENTION

Definitions

Figure 1:
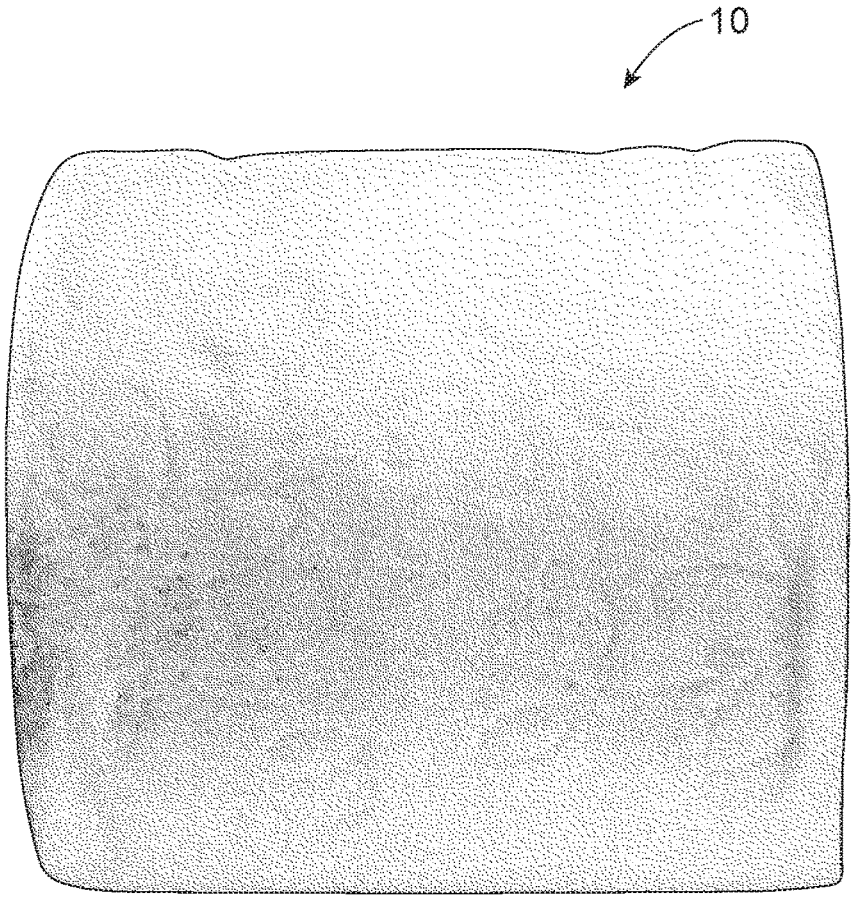
Fig. 1 Prior Art
FIG. 1 is an image of a fibrous structure comprising prior art extracted trichomes processed by a prior art process for extracting trichomes from a plant.

"Trichome" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant.

Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture.

A trichome may be formed by one cell or many cells.

The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass further comprising other materials. Other materials includes non-trichome-bearing fragments of the host plant.

In one example of the present invention, the individualized trichomes may be classified to enrich the individualized trichomal content at the expense of mass not constituting individualized trichomes.

Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized trichomes may also be used in their physical form, usually fibrous, and herein referred to "trichome fibers", as a component of fibrous structures.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are non-limiting examples of seed hair fibers.

Further, trichome fibers are different from nonwood bast and/or core fibers in that they are not attached to the bast, also known as phloem, or the core, also known as xylem portions of a nonwood dicotyledonous plant stem. Non-limiting examples of plants which have been used to yield nonwood bast fibers and/or nonwood core fibers include kenaf, jute, flax, ramie and hemp.

Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant.

Further, trichome fibers are different from leaf fibers in that they do not originate from within the leaf structure. Sisal and abaca are sometimes liberated as leaf fibers.

Finally, trichome fibers are different from wood pulp fibers since wood pulp fibers are not outgrowths from the epidermis of a plant; namely, a tree. Wood pulp fibers rather originate from the secondary xylem portion of the tree stem.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, such as trichome fibers and/or wood pulp fibers, or synthetic fibers, or any other suitable fibers, and any combination thereof.

Natural fibrous structure-making fibers useful in the present invention include animal fibers, mineral fibers, other plant fibers (in addition to the trichomes of the present invention) and mixtures thereof. Animal fibers may, for example, be selected from the group consisting of: wool, silk and mixtures thereof. The other plant fibers may, for example, be derived from a plant selected from the group consisting of: wood, cotton, cotton linters, flax, sisal, abaca, hemp, hesperaloe, jute, bamboo, bagasse, kudzu, corn, sorghum, gourd, agave, loofah and mixtures thereof.

Wood fibers; often referred to as wood pulps include chemical pulps, such as kraft (sulfate) and sulfite pulps, as well as mechanical and semi-chemical pulps including, for example, groundwood, thermomechanical pulp, chemi-mechanical pulp (CMP), chemi-thermomechanical pulp (CTMP), neutral semi-chemical sulfite pulp (NSCS). Chemical pulps, however, may be preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. The hardwood and softwood fibers can be blended, or alternatively, can be deposited in layers to provide a stratified and/or layered web. U.S. Pat. No. 4,300,981 and U.S. Pat. No. 3,994,771 are incorporated herein by reference for the purpose of disclosing layering of hardwood and softwood fibers. Also applicable to the present invention are fibers derived from recycled paper, which may contain any or all of the above categories as well as other non-fibrous materials such as fillers and adhesives used to facilitate the original papermaking.

The wood pulp fibers may be short (typical of hardwood fibers) or long (typical of softwood fibers). Non-limiting examples of short fibers include fibers derived from a fiber source selected from the group consisting of Acacia, *Eucalyptus*, Maple, Oak, Aspen, Birch, Cottonwood, Alder, Ash, Cherry, Elm, Hickory, Poplar, Gum, Walnut, Locust, Sycamore, Beech, *Catalpa, Sassafras*, Gmelina, *Albizia*, Anthocephalus, and *Magnolia*. Non-limiting examples of long fibers include fibers derived from Pine, Spruce, Fir, Tamarack, Hemlock, Cypress, and Cedar. Softwood fibers derived from the kraft process and originating from more-northern climates may be preferred. These are often referred to as northern softwood kraft (NSK) pulps.

Synthetic fibers may be selected from the group consisting of: wet spun fibers, dry spun fibers, melt spun (including melt blown) fibers, synthetic pulp fibers and mixtures thereof. Synthetic fibers may, for example, be comprised of cellulose (often referred to as "rayon"); cellulose derivatives such as esters, ether, or nitrous derivatives; polyolefins (including polyethylene and polypropylene); polyesters (including polyethylene terephthalate); polyamides (often referred to as "nylon"); acrylics; non-cellulosic polymeric carbohydrates (such as starch, chitin and chitin derivatives such as chitosan); polylactic acids, polyhydroxyalkanoates, polycaprolactones, and mixtures thereof. In one example, synthetic fibers may be used as binding agents.

The web (fibrous structure) of the present invention may comprise fibers, films and/or foams that comprises a hydroxyl polymer and optionally a crosslinking system. Non-limiting examples of suitable hydroxyl polymers include polyols, such as polyvinyl alcohol, polyvinyl alcohol derivatives, polyvinyl alcohol copolymers, starch, starch derivatives, chitosan, chitosan derivatives, cellulose derivatives such as cellulose ether and ester derivatives, gums, arabinans, galactans, proteins and various other polysaccharides and mixtures thereof. For example, a web of the present invention may comprise a continuous or substantially continuous fiber comprising a starch hydroxyl polymer and a polyvinyl alcohol hydroxyl polymer produced by dry spinning and/or solvent spinning (both unlike wet spinning into a coagulating bath) a composition comprising the starch hydroxyl polymer and the polyvinyl alcohol hydroxyl polymer.

"Fiber Length", "Average Fiber Length" and "Weighted Average Fiber Length", are terms used interchangeably herein all intended to represent the "Length Weighted Average Fiber Length" as determined for example by means of a Kajaani FiberLab Fiber Analyzer commercially available from Metso Automation, Kajaani Finland. The instructions supplied with the unit detail the formula used to arrive at this average. The recommended method for measuring fiber length using this instrument is essentially the same as detailed by the manufacturer of the FiberLab in its operation manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wis.

Fibrous structures may be comprised of a combination of long fibers and short fibers.

Non-limiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Non-limiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

The individualized trichomes used in the present invention may include trichome fibers. The trichome fibers may be characterized as either long fibers or short fibers.

"Harvest" or "harvesting" as used herein means a process of gathering mature plants, for example by cutting and then collecting the plants, from a field, which may optionally include moving the plants to a processing operation or storage area.

"Stem" as used herein means a plant's axis that bears buds and shoots with leaves and, at its basal end, roots. In one example, the stem is the stalk of a plant.

"Sifting" as used herein means a process that separates and retains coarse parts with a sieve and/or screen allowing less coarse parts to pass through the sieve and/or screen.

"Fibrous structure" as used herein means a structure that comprises one or more fibers. Non-limiting examples of processes for making fibrous structures include known wet-laid papermaking processes and air-laid papermaking processes. Such processes typically include steps of preparing a fiber composition in the form of a suspension in a medium, either wet, more specifically aqueous medium, or dry, more specifically gaseous, i.e. with air as medium. The aqueous medium used for wet-laid processes is oftentimes referred to as a fiber slurry. The fibrous suspension is then used to deposit a plurality of fibers onto a forming wire or belt such that an embryonic fibrous structure is formed, after which drying and/or bonding the fibers together results in a fibrous structure. Further processing the fibrous structure may be carried out such that a finished fibrous structure is formed. For example, in typical papermaking processes, the finished fibrous structure is the fibrous structure that is wound on the reel at the end of papermaking, and may subsequently be converted into a finished product, e.g. a sanitary tissue product.

Non-limiting types of fibrous structures according to the present invention include conventionally felt-pressed fibrous structures; pattern densified fibrous structures; and high-bulk, uncompacted fibrous structures. The fibrous structures may be of a homogenous or multilayered (two or three or more layers) construction; and the sanitary tissue products made therefrom may be of a single-ply or multi-ply construction.

In one example, the fibrous structure of the present invention is a pattern densified fibrous structure characterized by having a relatively high-bulk region of relatively low fiber density and an array of densified regions of relatively high fiber density. The high-bulk field is characterized as a field of pillow regions. The densified zones are referred to as knuckle regions. The knuckle regions exhibit greater density than the pillow regions. The densified zones may be discretely spaced within the high-bulk field or may be interconnected, either fully or partially, within the high-bulk field. Typically, from about 8% to about 65% of the fibrous structure surface comprises densified knuckles, the knuckles may exhibit a relative density of at least 125% of the density of the high-bulk field. Processes for making pattern densified fibrous structures are well known in the art as exemplified in U.S. Pat. Nos. 3,301,746, 3,974,025, 4,191,609 and 4,637,859.

The fibrous structures comprising a trichome in accordance with the present invention may be in the form of through-air-dried fibrous structures, differential density fibrous structures, differential basis weight fibrous structures, wet laid fibrous structures, air laid fibrous structures (examples of which are described in U.S. Pat. Nos. 3,949,035 and 3,825,381), conventional dried fibrous structures, creped or uncreped fibrous structures, patterned-densified or non-patterned-densified fibrous structures, compacted or uncompacted fibrous structures, nonwoven fibrous structures comprising synthetic or multicomponent fibers, homogeneous or multilayered fibrous structures, double re-creped fibrous structures, foreshortened fibrous structures, co-form fibrous structures (examples of which are described in U.S. Pat. No. 4,100,324) and mixtures thereof.

In one example, the air laid fibrous structure is selected from the group consisting of thermal bonded air laid (TBAL) fibrous structures, latex bonded air laid (LBAL) fibrous structures and mixed bonded air laid (MBAL) fibrous structures.

The fibrous structures may exhibit a substantially uniform density or may exhibit differential density regions, in other words regions of high density compared to other regions within the patterned fibrous structure. Typically, when a fibrous structure is not pressed against a cylindrical dryer, such as a Yankee dryer, while the fibrous structure is still wet and supported by a through-air-drying fabric or by another fabric or when an air laid fibrous structure is not spot bonded, the fibrous structure typically exhibits a substantially uniform density.

"Sanitary tissue product" as used herein means a soft, low density (i.e. <about 0.15 g/cm$^3$) web useful as a wiping implement for post-urinary and post-bowel movement cleaning (toilet tissue), for otorhinolaryngological discharges (facial tissue), and multi-functional absorbent and cleaning uses (absorbent towels). The sanitary tissue product may be convolutedly wound upon itself about a core or without a core to form a sanitary tissue product roll.

In one example, the sanitary tissue product of the present invention comprises a fibrous structure according to the present invention.

The sanitary tissue products of the present invention may exhibit a basis weight between about 10 g/m$^2$ to about 120 g/m$^2$ and/or from about 15 g/m$^2$ to about 110 g/m$^2$ and/or from about 20 g/m$^2$ to about 100 g/m$^2$ and/or from about 30 to 90 g/m$^2$. In addition, the sanitary tissue product of the present invention may exhibit a basis weight between about 40 g/m$^2$ to about 120 g/m$^2$ and/or from about 50 g/m$^2$ to about 110 g/m$^2$ and/or from about 55 g/m$^2$ to about 105 g/m$^2$ and/or from about 60 to 100 g/m$^2$ as measured according to the Basis Weight Test Method described herein.

The sanitary tissue products of the present invention may exhibit a total dry tensile of at least 150 g/in and/or from about 200 g/in to about 1000 g/in and/or from about 250 g/in to about 850 g/in as measured according to the Tensile Test Method described herein.

In another example, the sanitary tissue product of the present invention may exhibit a total dry tensile of at least 300 g/in and/or at least 350 g/in and/or at least 400 g/in and/or at least 450 g/in and/or at least 500 g/in and/or from about 500 g/in to about 1000 g/in and/or from about 550 g/in to about 850 g/in and/or from about 600 g/in to about 800 g/in as measured according to the Total Dry Tensile Test Method described herein. In one example, the sanitary tissue product exhibits a total dry tensile strength of less than 1000 g/in and/or less than 850 g/in as measured according to the Tensile Test Method described herein.

In another example, the sanitary tissue products of the present invention may exhibit a total dry tensile of at least 500 g/in and/or at least 600 g/in and/or at least 700 g/in and/or at least 800 g/in and/or at least 900 g/in and/or at least 1000 g/in and/or from about 800 g/in to about 5000 g/in and/or from about 900 g/in to about 3000 g/in and/or from about 900 g/in to about 2500 g/in and/or from about 1000 g/in to about 2000 g/in as measured according to the Tensile Test Method described herein.

"Basis Weight" as used herein is the weight per unit area of a sample reported in lbs/3000 ft$^2$ or g/m$^2$. Basis weight is measured by preparing one or more samples of a certain area (m$^2$) and weighing the sample(s) of a fibrous structure according to the present invention and/or a sanitary tissue product comprising such fibrous structure on a top loading balance with a minimum resolution of 0.01 g. The balance is protected from air drafts and other disturbances using a draft shield. Weights are recorded when the readings on the balance become constant. The average weight (g) is calculated and the average area of the samples (m$^2$) is measured. The basis weight (g/m$^2$) is calculated by dividing the average weight (g) by the average area of the samples (m$^2$).

"Softness" of a fibrous structure according to the present invention and/or a paper product comprising such fibrous structure is determined as follows. Ideally, prior to softness testing, the samples to be tested should be conditioned according to Tappi Method #T4020M-88. Here, samples are preconditioned for 24 hours at a relative humidity level of 10 to 35% and within a temperature range of 22° C. to 40° C. After this preconditioning step, samples should be conditioned for 24 hours at a relative humidity of 48% to 52% and within a temperature range of 22° C. to 24° C. Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. a grade of plus one is given if X is judged to may be a little softer than Y, and a grade of minus one is given if Y is judged to may be a little softer than X;

2. a grade of plus two is given if X is judged to surely be a little softer than Y, and a grade of minus two is given if Y is judged to surely be a little softer than X;

3. a grade of plus three is given to X if it is judged to be a lot softer than Y, and a grade of minus three is given if Y is judged to be a lot softer than X; and, lastly:

4. a grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

Trichomes

Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures. Trichomes may have a wide range of morphology and chemical properties. For example, the trichomes may be in the form of fibers; namely, trichome fibers. Such trichome fibers may have a high length to diameter ratio.

The following sources are offered as non-limiting examples of trichome-bearing plants (suitable sources) for obtaining trichomes, especially trichome fibers.

Non-limiting examples of suitable sources for obtaining trichomes, especially trichome fibers, are plants in the Labiatae (Lamiaceae) family commonly referred to as the mint family.

Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the Labiatae family include the *arcticus* subspecies of *Thymus praecox*, commonly referred to as creeping thyme and the *pseudolanuginosus* subspecies of *Thymus praecox*, commonly referred to as wooly thyme.

Further examples of suitable species in the Labiatae family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable species in the Labiatae family include *Lavandula lanata*, commonly referred to as wooly lavender; *Marrubium vulgare*, commonly referred to as horehound; *Plectranthus argentatus*, commonly referred to as silver shield; and *Plectranthus tomentosa.*

Non-limiting examples of other suitable sources for obtaining trichomes, especially trichome fibers are plants in the Asteraceae family commonly referred to as the sunflower family.

Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow; *Anaphalis margaritacea*, also known as pearly everlasting; and *Encelia farinose*, also known as brittle bush.

Additional examples of suitable species in the Asteraceae family include *Senecio brachyglottis* and *Senecio haworthii*, the latter also known as *Kleinia haworthii.*

Non-limiting examples of other suitable sources for obtaining trichomes, especially trichome fibers, are plants in the Scrophulariaceae family commonly referred to as the figwort or snapdragon family.

An example of a suitable species in the Scrophulariaceae family includes *Pedicularis kanei*, also known as the wooly lousewort.

Additional examples of suitable species in the Scrophulariaceae family include the mullein species (*Verbascum*) such as *Verbascum hybridium*, also known as snow maiden; *Verbascum thapsus*, also known as common mullein; *Verbascum baldaccii; Verbascum bombyciferum; Verbascum broussa; Verbascum chaixii; Verbascum dumulsum; Verbascum laciniatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'.

Further examples of suitable species in the Scrophulariaceae family include *Stemodia tomentosa* and *Stemodia durantifolia.*

Non-limiting examples of other suitable sources for obtaining trichomes, especially trichome fibers include *Greyia radlkoferi* and *Greyia flanmaganii* plants in the Greyiaceae family commonly referred to as the wild bottlebrush family.

Non-limiting examples of other suitable sources for obtaining trichomes, especially trichome fibers include members of the Fabaceae (legume) family. These include the *Glycine max*, commonly referred to as the soybean, and *Trifolium pratense* L, commonly referred to as medium and/or mammoth red clover.

Non-limiting examples of other suitable sources for obtaining trichomes, especially trichome fibers include members of the Solanaceae family including varieties of *Lycopersicum esculentum*, otherwise known as the common tomato.

Non-limiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Non-limiting examples of other suitable sources for obtaining trichomes, especially trichome fibers include members of the Malvaceae (mallow) family, including *Anoda cristata*, commonly referred to as spurred *anoda* and *Abutilon theophrasti*, commonly referred to as velvetleaf.

Non-limiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of *renardii* in the Geraniaceae (geranium) family; the *Tibouchina urvilleana*, commonly referred to as the Brazilian spider flower of the Melastomataceae family; the *Tillandsia recurvata*, commonly referred to as ballmoss of the Bromeliaceae (pineapple) family; the *Hypericum tomentosum*, commonly referred to as the wooly St. John's wort of the Hypericaceae family; the *Chorizanthe orcuttiana*, commonly referred to as the San Diego spineflower of the Polygonaceae family; *Eremocarpus setigerus*, commonly referred to as the doveweed of the Euphorbiaceae or spurge family; *Kalanchoe tomentosa*, commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, Mass.

The trichome-bearing material may be subjected to a mechanical process to liberate its trichomes from its plant epidermis to enrich the pulp or fiber mass' content of individualized trichomes. This may be carried out by means of screening or air classifying equipment well known in the art. A suitable air classifier is the Hosokawa Alpine 50ATP, sold by Hosokawa Micron Powder Systems of Summit, N.J. Other suitable classifiers are available from the Minox Siebtechnik.

In one example, a trichome suitable for use in the fibrous structures of the present invention comprises cellulose.

In yet another example, a trichome suitable for use in the fibrous structures of the present invention comprises a fatty acid.

In still another example, a trichome suitable for use in the fibrous structures of the present invention is hydrophobic.

In yet another example, a trichome suitable for use in the fibrous structures of the present invention is less hydrophilic that softwood fibers. This characteristic of the trichome may facilitate a reduction in drying temperatures needed to dry fibrous structures comprising such trichome and/or may facilitate making the fibrous structures containing such trichome at a faster rate.

Trichome fibers are greater in length than *Eucalyptus* fibers, but shorter than NSK fibers. However, other properties of trichome Fibrous Structures The fibrous structures of the present invention may comprise greater than 50% and/or greater than 75% and/or greater than 90% and/or 100% or less by weight on a dry fiber basis of pulp fibers.

In one example, the fibrous structures of the present invention comprise less than 22% and/or less than 21% and/or less than 20% and/or less than 19% and/or less than 18% and/or to about 5% and/or to about 7% and/or to about 10% and/or to about 12% and/or to about 15% by weight on a dry fiber basis of softwood fibers.

In one example, the fibrous structures of the present invention may exhibit a basis weight between about 10 $g/m^2$ to about 120 $g/m^2$ and/or from about 15 $g/m^2$ to about 110 $g/m^2$ and/or from about 20 $g/m^2$ to about 100 $g/m^2$ and/or from about 30 to 90 $g/m^2$. In addition, the sanitary tissue product of the present invention may exhibit a basis weight between about 40 $g/m^2$ to about 120 $g/m^2$ and/or from about 50 $g/m^2$ to about 110 $g/m^2$ and/or from about 55 $g/m^2$ to about 105 $g/m^2$ and/or from about 60 to 100 $g/m^2$ as measured according to the Basis Weight Test Method described herein.

In another example, the fibrous structures of the present invention may exhibit a basis weight of at least 21 $g/m^2$ and/or at least 23 $g/m^2$ and/or at least 25 $g/m^2$.

In yet another example, the fibrous structures of the present invention may comprise a plurality of pulp fibers, wherein greater than 0% but less than 20% by weight on a dry fiber basis of the pulp fibers are softwood fibers and wherein the fibrous structure comprises pulp fibers derived from a pulp fiber-producing source that has a growing cycle of less than 800 and/or every 400 and/or every 200 and/or every 100 or less days.

The fibrous structures of the present invention may comprise one or more individualized trichomes, especially trichome fibers. In one example, a trichome fiber suitable for use in the fibrous structures of the present invention exhibit a fiber length of from about 100 μm to about 7000 μm and a width of from about 3 μm to about 30 μm.

In addition to a trichome, other fibers and/or other ingredients may also be present in the fibrous structures of the present invention.

Fibrous structures according to this invention may contain from about 0.1% to about 100% and/or from about 0.5% to about 90% and/or from about 0.5% to about 80% and/or from about 0.5% to about 50% and/or from about 1% to about 40% and/or from about 2% to about 30% and/or from about 5% to about 25% by weight on a dry fiber basis of trichome fibers. In one example, the fibrous structures of the present invention comprise at least 1% and/or at least 3.5% and/or at least 5% and/or at least 7.5% and/or at least 10% by weight on a dry fiber basis of trichome fibers.

In addition to a trichome, the fibrous structure may comprise other additives, such as wet strength additives, softening additives, solid additives (such as starch, clays), dry strength resins, wetting agents, lint resisting and/or reducing agents, absorbency-enhancing agents, immobilizing agents, especially in combination with emollient lotion compositions, antiviral agents including organic acids, antibacterial agents, polyol polyesters, antimigration agents, polyhydroxy plasticizers and mixtures thereof. Such other additives may be added to the fiber furnish, the embryonic fibrous web and/or the fibrous structure.

Such other additives may be present in the fibrous structure at any level based on the dry weight of the fibrous structure.

The other additives may be present in the fibrous structure at a level of from about 0.001 to about 50% and/or from about 0.001 to about 20% and/or from about 0.01 to about 5% and/or from about 0.03 to about 3% and/or from about 0.1 to about 1.0% by weight, on a dry fibrous structure basis.

The fibrous structures of the present invention may be subjected to any suitable post processing including, but not limited to, printing, embossing, calendaring, slitting, folding, combining with other fibrous structures, and the like.

The use of trichomes (trichome fibers) in the fibrous structure making process permits the reduction of softwood fibers in the fibrous structure. In one example, the inclusion of trichome fibers permits at least a 5% by weight on a dry fiber basis reduction of softwood fibers while maintaining a total dry tensile strength of greater than 500 g/in and/or greater than 520 g/in and increasing the softness (PSU) to at least 0.67 and/or at least 1.00.

In one example, the replacement of softwood fibers with trichome fibers produces a fibrous structure and/or sanitary tissue product that exhibits a softness (PSU) increase of at least 0.5 and/or at least 0.67 and/or at least 1.00 compared to the same fibrous structure and/or sanitary tissue product without the trichome fibers.

In addition to the reduction of softwood fibers, the inclusion of trichome fibers, may result, especially when they are added to an outer layer or in a homogeneous fibrous structure, in a surface that has a "fuzzy" feel to consumers. In addition, the trichome fibers may also provide surface smoothness increases, strength increases and flexibility increases to the fibrous structures.

Processes for Extracting Trichomes from Plants

Figure 2:
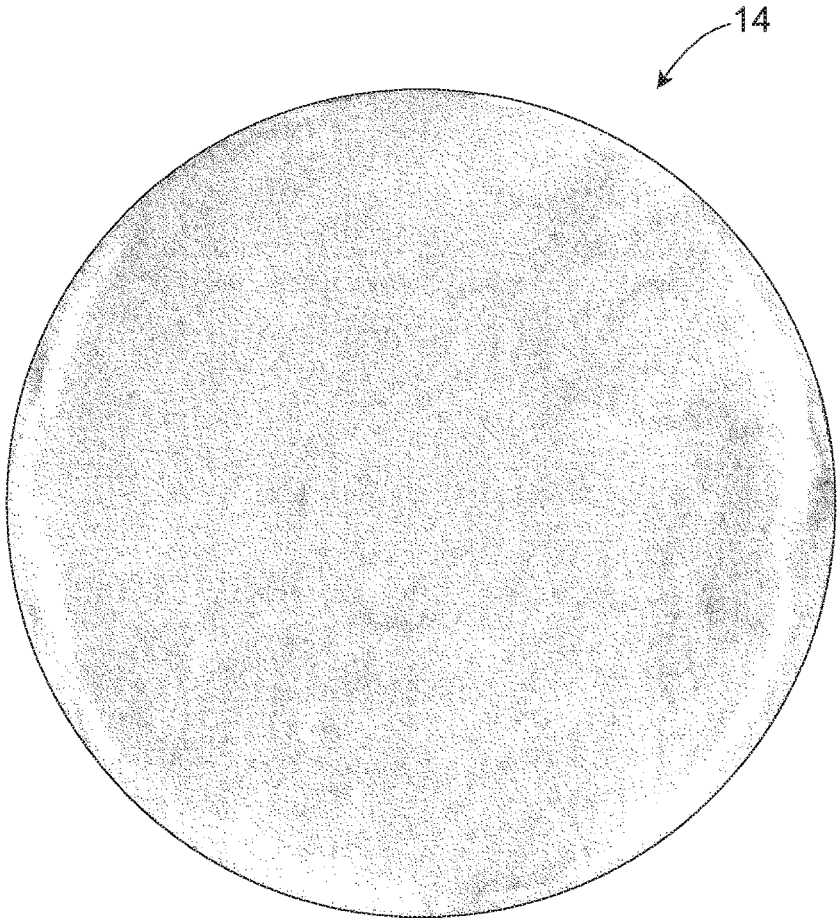
FIG. 2 is an image of an example of extracted trichomes processed according to the present invention.

The processes of the present invention separate trichomes from a mixture of trichomes and non-trichome materials such that the resulting extracted trichomes 14, as shown in FIG. 2 in the form of a filter cake, are substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Trichomes Purity Test Method.

Figure 3A:
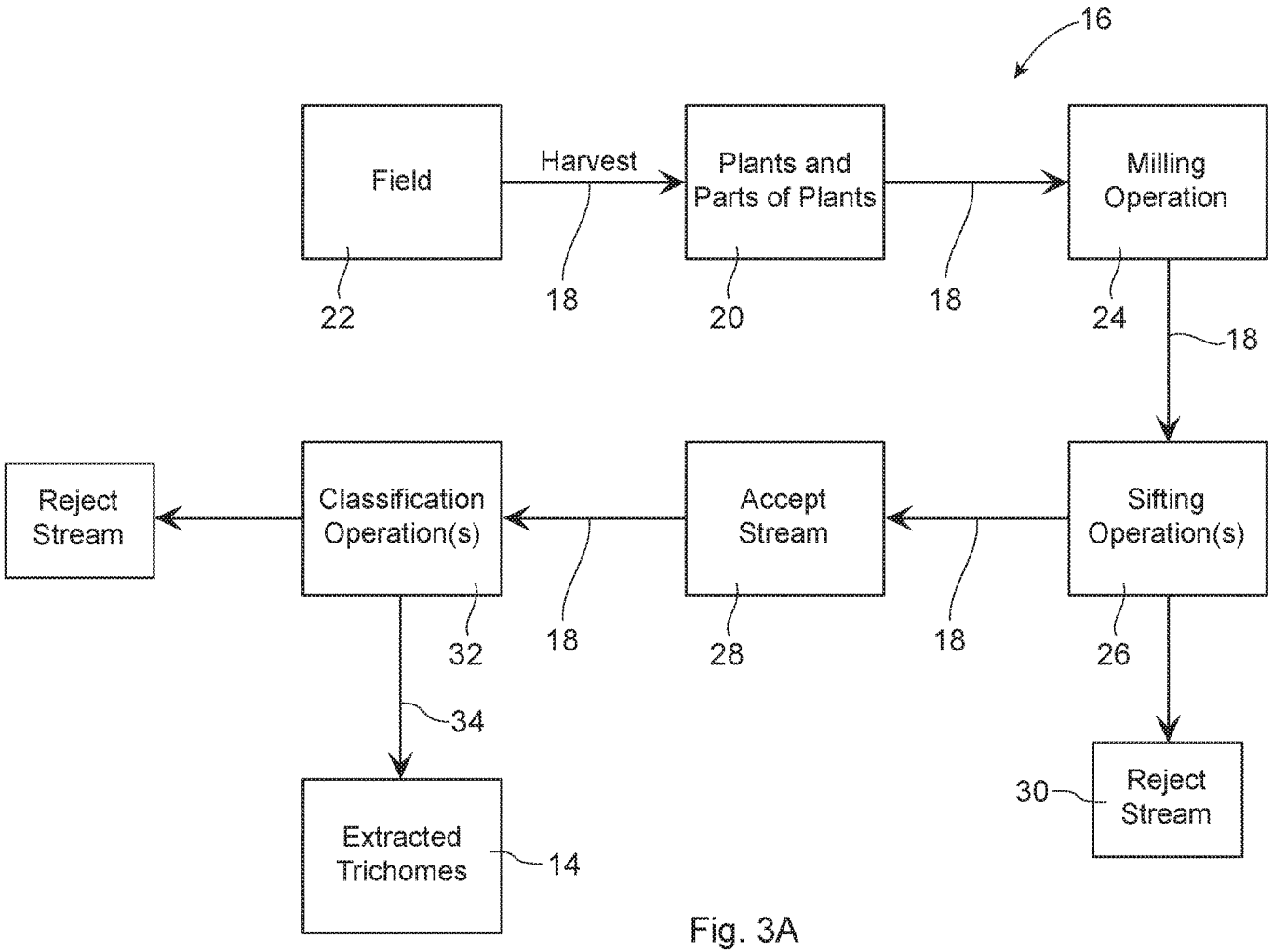
FIG. 3A is a flow chart illustrating an example of a process according to the present invention.
Figure 3B:
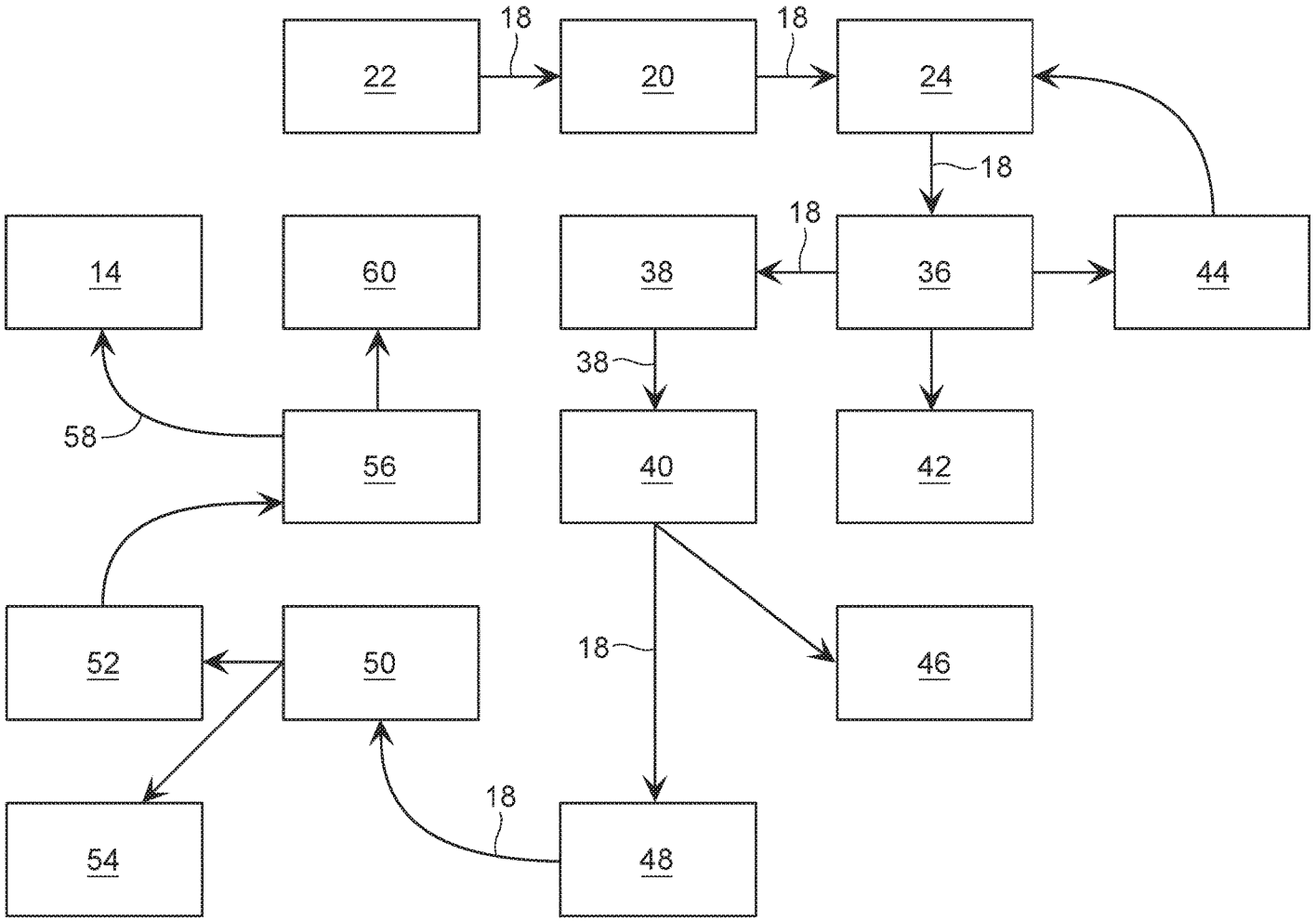
FIG. 3B is a flow chart illustrating another example of a process according to the present invention.

As shown in FIGS. 3A and 3B, examples of processes for extracting trichomes from non-trichome materials 16 according to the present invention comprises the steps of:

a. providing a mixture of trichomes and non-trichome materials 18; and b. separating the trichomes from the non-trichome materials to produce extracted trichomes 14, wherein the extracted trichomes 14 are substantially free of non-trichome materials having an average particle size of 0.0001 $cm^2$ or greater as measured according to the Trichomes Purity Test Method.

The mixture of trichomes and non-trichome materials 18, as shown in FIGS. 3A and 3B, may be obtained from a plant and/or parts of a plant 20, such as a trichome-bearing plant. In one example, the process further comprises the step of harvesting the plant, for example from a field 22. In one example, the plant may be in the *Stachys* genus, for example the plant may be *Stachys byzantina* or otherwise known as "Lamb's Ear." In another example, the plant may be any trichome-bearing plant, for example any plants that bear the trichomes described herein.

As shown in FIGS. 3A and 3B, the process of the present invention may further comprise the step of: subjecting the plant, for example trichome-bearing plant, to one or more milling operations 24, such as by passing the plant through a hammermill, that separates the plant into two or more different discrete portions. In one example, at least one of the two or more different discrete portions from the milling operation 24 is leaves of the plant. In another example, at least one of the two or more different discrete portions from the milling operation 24 is the stem of the plant.

The process for extracting 16, as shown in FIG. 3A, may further comprise the step of: subjecting the two or more different discrete portions from the milling operation 24 to one or more sifting operations 26. In one example, the step of subjecting the two or more different discrete portions to a sifting operation 26 comprises the step of passing at least one of the two or more discrete portions through a sieve to produce an accept stream 28. The sifting operation 26 also produces a reject stream 30 that can be discarded or recycled. The accept stream 28 comprises trichomes and optionally, non-trichome materials.

The process for extracting 16, as shown in FIG. 3A, may further comprise the step of: subjecting the accept stream 28 from the sifting operation 26 to one or more classification operations 32 to classify the accept stream 28 based on size to produce a classified stream 34 comprising extracted trichomes 14 that are substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Trichomes Purity Test Method. In one example, the step of subjecting the accept stream 28 to one or more classification operations 32 comprises the step of passing the accept stream 28 through an air classifier. In another example, the step of subjecting the accept stream 28 to one or more classification operations 32 comprises the step of passing the accept stream 28 through a hydrocyclone. In one example, the trichomes and non-trichome materials are separated based on density. In one example, the trichomes are less dense than the non-trichome materials. In still another example, the step of subjecting the accept stream 28 to one or more classification operations 32 comprises the step of passing the accept stream 28 through a screen, such as a pressure screen, such as a slotted pressure screen. In one example, the screen is a center screen, for example a slotted center pressure screen. The slotted screen may comprise slots that are sized to permit trichomes to pass through the slots. In one example, the slots have a minimal dimension of less than 0.004 mm and/or less than 0.003 mm and/or less than 0.0025 mm and/or less than 0.002 mm and/or greater than 0.0017 mm and/or at least 0.0018 mm. In one example, the screen is a pressure screen, for example a slotted, center pressure screen available from Kadant Black Clawson of Mason, Ohio. In one example, the slotted screen comprises slots that have a maximum dimension of less than 30 μm and/or less than 25 μm.

The process for extracting 16, as shown in FIG. 3A, may further comprise contacting the accept stream 28 with moisture, such as water, for example by spraying water onto the accept stream 28.

In another example, the process for extracting 16, as shown in FIG. 3A, may further comprise the step of contacting the classified stream 34 with moisture, such as water, for example by spraying water onto the classified stream 34.

As shown in FIG. 3B, the process for extracting 16 may further comprise the step of: subjecting the two or more different discrete portions from the milling operation 24 to one or more vibrating separating operations 36. In one example, the step of subjecting the two or more different discrete portions to a vibrating separating operation 36 comprises the step of passing at least one of the two or more discrete portions through a sieve, for example comprising one or more and/or two or more and/or three or more screens, to produce 1) an accept stream of trichomes and non-trichome materials 38 suitable for further processing in a cyclone operation 40, such as a dry air cyclone; 2) a reject stream 42 (namely dirt and/or debris and other non-trichome materials, which can be discarded or recycled); and 3) a non-accept stream of trichomes and non-trichome materials 44, including some dirt and/or soil, 44 in the form of clumps and/or agglomerates such that they are unsuitable for processing in the cyclone operation 40.

The process for extracting 16, as shown in FIG. 3B, may further comprise the step of: subjecting the non-accept trichome and non-trichome materials stream 44 in the form of clumps/agglomerates to another milling operation 24, the same or different from the previous milling operation 24 and then passing the mixture of trichomes and non-trichome materials 18 coming from the second milling operation 24 through the vibrating separating operation 36 again. These steps can be repeated as necessary until the accept trichome and non-trichome materials stream 38 is free or substantially free of clumps/agglomerates.

The accept stream of trichomes and non-trichome materials 38 may be further processed by passing the accept stream 38 through a cyclone 40, such as a dry air cyclone. An accept stream of clean trichomes 46 results from the cyclone 40 operation. The yield of clean trichomes 46 from this cyclone 40 operation may not be sufficient so further processing of the cyclone operation reject stream of trichomes and non-trichome materials, including dirt and/or soil, 48 resulting from the cyclone 40 operation may be performed.

The cyclone operation reject stream of trichomes and non-trichome materials 48 may be passed through a slotted pressure screen 50 to produce a further accept stream of trichomes and dirt/soil 52 and a reject stream of other non-trichome materials, which may comprise dirt and/or soil, 54. This reject stream 54 may be discarded and/or recycled.

The accept stream of trichomes and dirt/soil 52 however may be further processed by passing the accept stream 52 through one or more hydrocyclone operations 56. The resulting accept stream 58 resulting from the hydrocyclone operations 56 is clean trichomes, at a relatively high yield. The reject stream 60 from the hydrocyclone operations 56 is dirt/soil that may be discarded or recycled.

In one example, the extracted trichomes 14 (the "purified" trichomes) may be washed and filtered to form a filter cake and then analyzed to determine the total surface area provided by the total non-trichome materials present, if any, in the extracted trichomes 14. In one example, the total non-trichome materials present in the extracted trichomes 14 exhibit a total surface area of less than 0.2% and/or less than 0.15% and/or less than 0.1% and/or less than 0.05% and/or less than 0.025% and/or less than 0.0245% as measured according to the Trichomes Purity Test Method.

Figure 4:
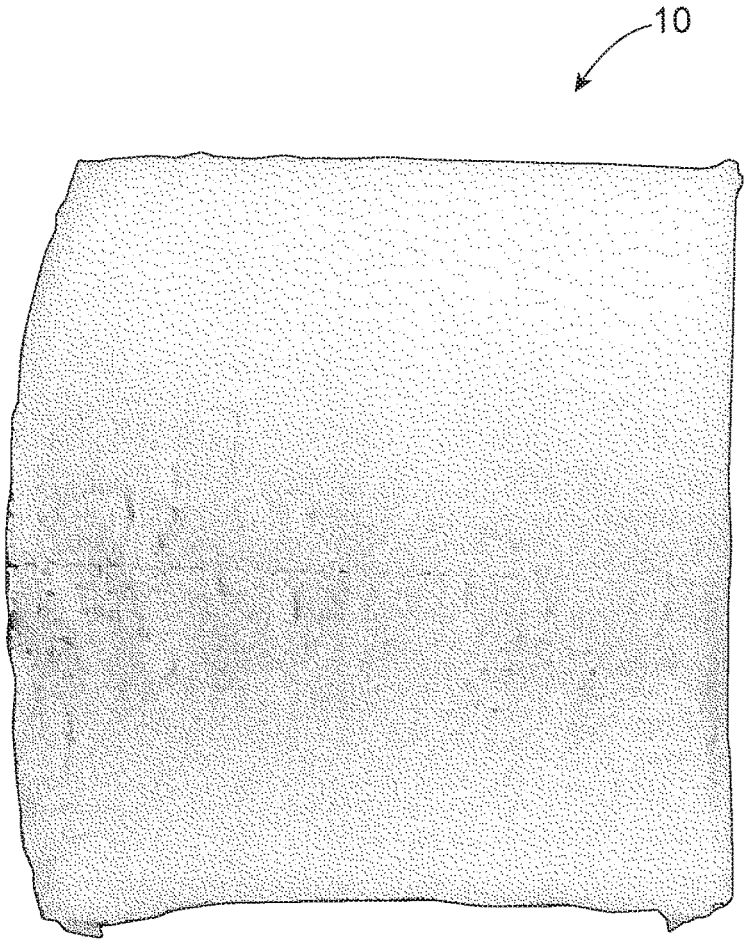
FIG. 4 is an image of an example of a fibrous structure comprising extracted trichomes according to the present invention.

In one example, a plurality of extracted trichomes 14, even in filter cake form, that are substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Trichomes Purity Test Method are obtained from the process of the present invention. Such extracted trichomes 14 may be used to make the fibrous structures 10 of the present invention as shown in FIG. 4.

Processes for Making Trichome-Containing Fibrous Structures

Any suitable process for making fibrous structures known in the art may be used to make trichome-containing fibrous structures of the present invention so long as the extracted trichomes of the present invention are used and/or the fibrous structure made exhibits the properties of the fibrous structures of the present invention.

In one example, the trichome-containing fibrous structures of the present invention are made by a wet laid fibrous structure making process.

In another example, the trichome-containing fibrous structures of the present invention are made by an air laid fibrous structure making process.

In one example, a trichome-containing fibrous structure is made by the process comprising the steps of: a) preparing a fiber furnish (slurry) by mixing a trichome with water; b) depositing the fiber furnish on a foraminous forming surface to form an embryonic fibrous web; and c) drying the embryonic fibrous web.

In one example, a fiber furnish comprising a trichome, such as a trichome fiber, is deposited onto a foraminous forming surface via a headbox.

In one example, a process for making a fibrous structure comprises the steps of:

a. providing a fiber furnish comprising extracted trichomes according to the present invention;

b. depositing the fiber furnish on a foraminous forming surface to form an embryonic fibrous web; and c. drying the embryonic fibrous web to form a fibrous structure.

The fiber furnish may further comprise wood pulp fibers. The wood pulp fibers may be selected from the group consisting of: hardwood pulp fibers, softwood pulp fibers, and mixtures thereof. In one example, the hardwood pulp fibers comprise *Eucalyptus* pulp fibers. In one example, the softwood pulp fibers comprise Northern Softwood Kraft pulp fibers (NSK pulp fibers). The fiber furnish may further comprise other wood and/or non-wood pulp fibers such as bamboo fibers.

In another example, a fibrous structure according to the present invention comprises a plurality of extracted trichomes according to the present invention such that the fibrous structure is substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Fibrous Structure Purity Test Method.

In another example, the fibrous structure of the present invention may comprise a plurality of extracted trichomes such that the total non-trichome materials present in the fibrous structure exhibits a total surface area of less than 0.2% and/or less than 0.17% and/or less than 0.15% and/or less than 0.12% and/or less than 0.1% and/or less than 0.09% and/or less than 0.08% as measured according to the Fibrous Structure Purity Test Method.

In still another example, a fibrous structure of the present invention may comprise a plurality of individualized trichomes such that the fibrous structure is substantially free of (less than 5% and/or less than 4% and/or less than 3% and/or less than 2% and/or less than 1% and/or less than 0.5% and/or about 0% by weight of non-trichome materials) non-trichome materials having an average particle size of 0.0001 $cm^2$ or greater and/or 0.00009 $cm^2$ or greater and/or 0.00008 $cm^2$ or greater and/or 0.00006 $cm^2$ as measured according to the Fibrous Structure Purity Test Method.

In yet another example, the fibrous structure of the present invention may comprise a plurality of individualized trichomes such that the total non-trichome materials present in the fibrous structure exhibits a total surface area of less than 0.2% and/or less than 0.17% and/or less than 0.15% and/or less than 0.12% and/or less than 0.1% and/or less than 0.09% and/or less than 0.08% as measured according to the Fibrous Structure Purity Test Method.

In one example, one or more of the trichomes (extracted trichomes and/or individualized trichomes) used to make the fibrous structures of the present invention are derived from a plant in the *Stachys* genus, for example *Stachys byzantina*.

In yet another example, the fibrous structures of the present invention comprising trichomes (extracted trichomes and/or individualized trichomes) may exhibit a softness (PSU) increase of at least 0.5 compared to the fibrous structures without the trichomes (extracted trichomes and/or individualized trichomes).

Further, the fibrous structures of the present invention may further comprises wood pulp fibers, for example softwood pulp fibers, hardwood pulp fibers, and mixtures thereof. In one example, the softwood pulp fibers are selected from the group consisting of: southern softwood kraft pulp fibers, northern softwood kraft pulp fibers, and mixtures thereof. In one example, the hardwood pulp fibers are selected from the group consisting of: northern hardwood pulp fibers, tropical hardwood pulp fibers, and mixtures thereof. The tropical hardwood fibers may be selected from the group consisting of: *eucalyptus* fibers, acacia fibers, and mixtures thereof. In one example, the hardwood pulp fibers are derived from a fiber source selected from the group consisting of: Acacia, *Eucalyptus*, Maple, Oak, Aspen, Birch, Cottonwood, Alder, Ash, Cherry, Elm, Hickory, Poplar, Gum, Walnut, Locust, Sycamore, Beech, *Catalpa, Sassafras*, Gmelina, *Albizia*, Anthocephalus, *Magnolia*, and mixtures thereof.

In one example, the fibrous structures of the present invention comprise less than 100% and/or less than 90% and/or less than 80% and/or less than 70% and/or less than 60% and/or less than 50% and/or less than 40% and/or less than 30% and/or less than 20% and/or less than 10% and/or less than 5% and/or less than 3% by weight on a dry fiber basis of hardwood pulp fibers. In another example, the fibrous structures of the present invention are void of hardwood pulp fibers.

In another example, the fibrous structures of the present invention may further comprise one or more synthetic fibers.

The fibrous structures of the present invention may further comprise one or more optional additives, for example a softening agent. Non-limiting examples of suitable softening agents include quaternary ammonium compounds, silicones, and mixtures thereof.

The fibrous structures of the present invention may exhibit a Basis Weight of greater than 10 $g/m^2$ as measured according to the Basis Weight Test Method.

In one example, the fibrous structure of the present invention is a through-air-dried fibrous structure.

In one example, the fibrous structure of the present invention is an uncreped through-air-dried fibrous structure.

In one example, the fibrous structure of the present invention is a conventional fibrous structure.

In one example, the fibrous structure of the present invention is a creped fibrous structure.

In one example, the fibrous structure of the present invention is a fabric creped fibrous structure.

In one example, the fibrous structure of the present invention is a belt creped fibrous structure.

In one example, the fibrous structure of the present invention is an uncreped fibrous structure.

In one example, the fibrous structure of the present invention is an embossed fibrous structure.

In one example, the fibrous structure of the present invention is a wet-molded fibrous structure.

NON-LIMITING EXAMPLES

Example 1: Fibrous Structure without Trichomes

The following example illustrates a non-limiting example for the preparation of a non-trichome containing fibrous structure on a pilot-scale Fourdrinier paper making machine.

A sheet with 33%×34%×33% layering consist of fabric layer, center layer and wire layer. The entire sheet has 70% by weight on a dry fiber basis of *Eucalyptus* and 30% by weight on a dry fiber basis of NSK pulp fibers is made.

An aqueous slurry of *eucalyptus* fibers is prepared at about 3% by weight using a conventional repulper. Separately, an aqueous slurry of NSK fibers of about 3% by weight is made up using a conventional repulper.

In order to impart temporary wet strength to the finished fibrous structure, a 1% dispersion of temporary wet strengthening additive (e.g., Parez® commercially available from Kemira) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The *eucalyptus* fiber slurry is diluted with white water at the inlet of a fan pump to a consistency of about 0.15% based on the total weight of the *eucalyptus* fiber slurry. The NSK fibers, likewise, are diluted with white water at the inlet of a fan pump to a consistency of about 0.15% based on the total weight of the NSK fiber slurry. The *eucalyptus* fiber slurry and the NSK fiber slurry are both directed to a layered headbox capable of maintaining the slurries as separate streams until they are deposited onto a forming fabric on the Fourdrinier.

"DC 2310" (Dow Corning, Midland, Mich.) antifoam is dripped into the wirepit to control foam to maintain white-water levels of 10 ppm.

The paper making machine has a layered headbox with a top chamber, a center chamber, and a bottom chamber. The *eucalyptus* fiber slurry is pumped through the top and bottom headbox chambers and, simultaneously, the NSK fiber slurry is pumped through the center headbox chamber and delivered in superposed relation onto a Fourdrinier wire to form thereon a three-layer embryonic web, of which about 70% is made up of the *eucalyptus* fibers and about 30% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is about the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 98×62 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 lbs/3000 $ft^2$.

The resulting total dry tensile strength for the fibrous structure product having no trichomes is 566 g/in.

Example 2: Fibrous Structure with Trichome Fibers

This following example illustrates a non-limiting example for the preparation of a fibrous structure according to the present invention on a pilot-scale Fourdrinier paper making machine with the addition of trichome fibers providing a strength increase.

The following Example illustrates a non-limiting example for the preparation of sanitary tissue product comprising a fibrous structure according to the present invention on a pilot-scale Fourdrinier fibrous structure making machine.

Individualized trichome are first prepared from *Stachys byzantina* bloom stalks consisting of the dried stems, leaves, and pre-flowering buds, by passing dried *Stachys byzantina* plant matter through a knife cutter (Wiley mill, manufactured by the C. W. Brabender Co. located in South Hackensack, N.J.) equipped with an attrition screen having ¼" holes. Exiting the Wiley mill is a composite fluff constituting the individualized trichome fibers together with chunks of leaf and stem material. The individualized trichomes are then subjected to a sifting operation and then the individualized trichome fluff is then passed through a classification operation, for example a hydrocyclone; the "accepts" or "fine" fraction from the hydrocyclone is greatly enriched in individualized trichome fibers while the "rejects" or "coarse" fraction is primarily chunks of stalks, and leaf elements with only a minor fraction of individualized trichome fibers. The individualized trichomes are then passed through a slotted pressure screen (UV100 from Kadant Black Clawson of Mason, Ohio). The resulting individualized trichome material (fines) is mixed with a 10% aqueous dispersion of "Texcare 4060" to add about 10% by weight "Texcare 4060" by weight of the bone dry weight of the individualized trichomes followed by slurrying the "Texcare"-treated trichome in water at 3% consistency using a conventional repulper. This slurry is passed through a stock pipe toward another stock pipe containing a *eucalyptus* fiber slurry.

Special care must be taken while processing the trichomes. 60 lbs. of trichome fiber is pulped in a 50 gallon pulper by adding water in half amount required to make a 1% trichome fiber slurry. This is done to prevent trichome fibers over flowing and floating on surface of the water due to lower density and hydrophobic nature of the trichome fiber. After mixing and stirring a few minutes, the pulper is stopped and the remaining trichome fibers are pushed in while water is added. After pH adjustment, it is pulped for 20 minutes, then dumped in a separate chest for delivery onto the machine headbox. This allows one to place trichome fibers in one or more layers, alone or mixed with other fibers, such as hardwood fibers and/or softwood fibers. During this particular run, the trichome fibers are added exclusively on the wire outer layer as the product is converted wire side up; therefore it is desirable to add the trichome fibers to the wire side (the side where the tactile feel senses paper the most).

The aqueous slurry of *eucalyptus* fibers is prepared at about 3% by weight using a conventional repulper. This slurry is also passed through a stock pipe toward the stock pipe containing the trichome fiber slurry.

The 1% trichome fiber slurry is combined with the 3% *eucalyptus* fiber slurry in a proportion which yields about 13.3% trichome fibers and 86.7% *eucalyptus* fibers. The stockpipe containing the combined trichome and *eucalyptus* fiber slurries is directed toward the wire layer of headbox of a Fourdrinier machine.

Separately, an aqueous slurry of NSK fibers of about 3% by weight is made up using a conventional repulper.

In order to impart temporary wet strength to the finished fibrous structure, a 1% dispersion of temporary wet strengthening additive (e.g., Parez® commercially available from Kemira) is prepared and is added to the NSK fiber stock pipe at a rate sufficient to deliver 0.3% temporary wet strengthening additive based on the dry weight of the NSK fibers. The absorption of the temporary wet strengthening additive is enhanced by passing the treated slurry through an in-line mixer.

The trichome fiber and *eucalyptus* fiber slurry is diluted with white water at the inlet of a fan pump to a consistency of about 0.15% based on the total weight of the *eucalyptus* and trichome fiber slurry. The NSK fibers, likewise, are diluted with white water at the inlet of a fan pump to a consistency of about 0.15% based on the total weight of the NSK fiber slurry. The *eucalyptus*/trichome fiber slurry and the NSK fiber slurry are both directed to a layered headbox capable of maintaining the slurries as separate streams until they are deposited onto a forming fabric on the Fourdrinier.

"DC 2310" antifoam is dripped into the wirepit to control foam to maintain whitewater levels of 10 ppm of antifoam.

The fibrous structure making machine has a layered headbox having a top chamber, a center chamber, and a bottom chamber. The *eucalyptus*/trichome combined fiber slurry is pumped through the top headbox chamber, *euca-*

*lyptus* fiber slurry is pumped through the bottom headbox chamber, and, simultaneously, the NSK fiber slurry is pumped through the center headbox chamber and delivered in superposed relation onto the Fourdrinier wire to form thereon a three-layer embryonic web, of which about 83% is made up of the *eucalyptus*/trichome fibers and 17% is made up of the NSK fibers. Dewatering occurs through the Fourdrinier wire and is assisted by a deflector and vacuum boxes. The Fourdrinier wire is of a 5-shed, satin weave configuration having 87 machine-direction and 76 cross-machine-direction monofilaments per inch, respectively. The speed of the Fourdrinier wire is about 750 fpm (feet per minute).

The embryonic wet web is transferred from the Fourdrinier wire, at a fiber consistency of about 15% at the point of transfer, to a patterned drying fabric. The speed of the patterned drying fabric is the same as the speed of the Fourdrinier wire. The drying fabric is designed to yield a pattern densified tissue with discontinuous low-density deflected areas arranged within a continuous network of high density (knuckle) areas. This drying fabric is formed by casting an impervious resin surface onto a fiber mesh supporting fabric. The supporting fabric is a 45×52 filament, dual layer mesh. The thickness of the resin cast is about 12 mils above the supporting fabric. A suitable process for making the patterned drying fabric is described in published application US 2004/0084167 A1.

Further de-watering is accomplished by vacuum assisted drainage until the web has a fiber consistency of about 30%.

While remaining in contact with the patterned drying fabric, the web is pre-dried by air blow-through pre-dryers to a fiber consistency of about 65% by weight.

After the pre-dryers, the semi-dry web is transferred to the Yankee dryer and adhered to the surface of the Yankee dryer with a sprayed creping adhesive. The creping adhesive is an aqueous dispersion with the actives consisting of about 22% polyvinyl alcohol, about 11% CREPETROL A3025, and about 67% CREPETROL R6390. CREPETROL A3025 and CREPETROL R6390 are commercially available from Hercules Incorporated of Wilmington, Del. The creping adhesive is delivered to the Yankee surface at a rate of about 0.15% adhesive solids based on the dry weight of the web. The fiber consistency is increased to about 97% before the web is dry creped from the Yankee with a doctor blade.

The doctor blade has a bevel angle of about 25 degrees and is positioned with respect to the Yankee dryer to provide an impact angle of about 81 degrees. The Yankee dryer is operated at a temperature of about 350° F. (177° C.) and a speed of about 800 fpm. The fibrous structure is wound in a roll using a surface driven reel drum having a surface speed of about 656 feet per minute. The fibrous structure may be subsequently converted into a two-ply sanitary tissue product having a basis weight of about 50 g/m$^2$.

5% by weight of trichome fibers on the outer layer of the sheet produced a product with considerable softness. To control tensile, softwood fibers had to be removed by 7% to compensate for 5% addition of trichome fibers. The base product had a softness of −0.44 PSU compared to our standard but the fibrous structure made with trichome fibers had 1.05 PSU at a comparable wet and dry tensile. Adjusting for the base softness deficit the condition with trichome fibers softness would be at about 1.5 PSU. Other benefits of trichome fiber addition is that the pre-dryer temperatures may be reduced by at least 30° F., and in one example at least 30° F. to about 50° F. This is a significant temperature reduction that can be used for energy saving or increase machine capacity if it is drying limited. In addition to the benefits described above, the use of trichome fibers to reduce the use of pulp fibers, especially softwood pulp fibers, in making fibrous structures, such as sanitary tissue products, also has environmental benefits, such as reducing carbon footprint of fibrous structures, especially paper products that have historically been made from wood pulp, by reducing the usage wood pulp and thus tree usage while maintaining or increasing the softness of the fibrous structures. In addition, as is always clear from the above description, the use of trichome fibers in fibrous structure breaks the strength/softness contradiction that has historically plagued the fibrous structure, especially the sanitary tissue product industry by increasing strength while increasing softness of the fibrous structure.

Test Methods

Unless otherwise specified, all tests described herein including those described under the Definitions section and the following test methods are conducted on samples that have been conditioned in a conditioned room at a temperature of 73° F.±4° F. (about 23° C.±2.2° C.) and a relative humidity of 50%±10% for 2 hours prior to the test. All tests are conducted in such conditioned room. Do not test samples that have defects such as wrinkles, tears, holes, and like.

Tensile Test Method: Peak Elongation, Tensile Strength, TEA and Modulus

Peak Elongation, Tensile Strength, TEA and Tangent Modulus are measured on a constant rate of extension tensile tester with computer interface (a suitable instrument is the EJA Vantage from the Thwing-Albert Instrument Co. Wet Berlin, N.J.) using a load cell for which the forces measured are within 10% to 90% of the limit of the cell. Both the movable (upper) and stationary (lower) pneumatic jaws are fitted with smooth stainless steel faced grips, 25.4 mm in height and wider than the width of the test specimen. An air pressure of about 60 psi is supplied to the jaws.

Eight usable units of a fibrous structure and/or sanitary tissue product sample are divided into two stacks of four samples each. The samples in each stack are consistently oriented with respect to machine direction (MD) and cross direction (CD). One of the stacks is designated for testing in the MD and the other for CD. Using a one inch precision cutter (Thwing Albert JDC-1-10, or similar) cut 4 MD strips from one stack, and 4 CD strips from the other, with dimensions of 1.00 in ±0.01 in wide by 3.0-4.0 in long. Each strip of one usable unit thick will be treated as a unitary specimen for testing.

Program the tensile tester to perform an extension test, collecting force and extension data at an acquisition rate of 20 Hz as the crosshead raises at a rate of 2.00 in/min (5.08 cm/min) until the specimen breaks. The break sensitivity is set to 80%, i.e., the test is terminated when the measured force drops to 20% of the maximum peak force, after which the crosshead is returned to its original position.

Set the gauge length to 1.00 inch. Zero the crosshead and load cell. Insert at least 1.0 in of the unitary specimen into the upper grip, aligning it vertically within the upper and lower jaws and close the upper grips. Insert the unitary specimen into the lower grips and close. The unitary specimen should be under enough tension to eliminate any slack, but less than 5.0 g of force on the load cell. Start the tensile tester and data collection. Repeat testing in like fashion for all four CD and four MD unitary specimens.

Program the software to calculate the following from the constructed force (g) verses extension (in) curve:

Tensile Strength is the maximum peak force (g) divided by the sample width (in) and reported as g/in to the nearest 1 g/in.

Adjusted Gauge Length is calculated as the extension measured at 3.0 g of force (in) added to the original gauge length (in).

Peak Elongation is calculated as the extension at maximum peak force (in) divided by the Adjusted Gauge Length (in) multiplied by 100 and reported as % to the nearest 0.1%

Total Energy (TEA) is calculated as the area under the force curve integrated from zero extension to the extension at the maximum peak force (g*in), divided by the product of the adjusted Gauge Length (in) and specimen width (in) and is reported out to the nearest 1 g*in/in$^2$. Replot the force (g) verses extension (in) curve as a force (g) verses strain curve. Strain is herein defined as the extension (in) divided by the Adjusted Gauge Length (in).

Program the software to calculate the following from the constructed force (g) verses strain curve:

Tangent Modulus (Modulus) is the Modulus at 15 g/cm.

The Tensile Strength (g/in), Peak Elongation (%), Total Energy (g*in/in$^2$) and Modulus (g/cm), which is the Tangent Modulus at 15 g/cm), are calculated for the four CD unitary specimens and the four MD unitary specimens. Calculate an average for each parameter separately for the CD and MD specimens.

Calculations:

Geometric Mean Tensile Strength=Square Root of [MD Tensile Strength (g/in)×CD Tensile Strength (g/in)]

Geometric Mean Peak Elongation=Square Root of [MD Elongation (%)×CD Elongation (%)]

Geometric Mean TEA=Square Root of [MD TEA (g*in/in2)×CD TEA (g*in/in2)]

Geometric Mean Modulus=Square Root of [MD Modulus (g/cm) (at 15 g/cm)×CD Modulus (g/cm) (at 15 g/cm)]

Total Dry Tensile Strength (TDT)=MD Tensile Strength (g/in)+CD Tensile Strength (g/in)

Total TEA=MD TEA (g*in/in2)+CD TEA (g*in/in2)

Total Modulus=MD Modulus (g/cm)+CD Modulus (g/cm)

Tensile Ratio=MD Tensile Strength (g/in)/CD Tensile Strength (g/in)

Initial Total Wet Tensile Test Method

The initial total wet tensile of a dry fibrous structure is determined using a Thwing-Albert EJA Material Tester Instrument, Cat. No. 1350, equipped with 5000 g load cell available from Thwing-Albert Instrument Company, 14 Collings Ave. W. Berlin, N.J. 08091. 10% of the 5000 g load cell is utilized for the initial total wet tensile test.

i. Sample Preparation—A sample strip of dry fibrous structure to be tested [2.54 cm (1 inch) wide by greater than 5.08 cm (2 inches)] long is obtained.

ii. Operation—The test settings for the instrument are:
   Crosshead speed—10.16 cm/minute (4.0 inches/minute)
   Initial gauge length 2.54 cm (1.0 inch)
   Adjust the load cell to read zero plus or minus 0.5 grams$_{force}$ (g$_f$)

iii. Testing Samples—One end of the sample strip is placed between the upper jaws of the machine and clamped. After verifying that the sample strip is hanging straight between the lower jaws, clamp the other end of the sample strip in the lower jaws.

a. Pre-Test—Strain the sample strip to 25 grams$_{force}$ (+/−10 grams$_{force}$) at a strain rate of 3.38 cm/minute (1.33 inches/minute) prior to wetting the sample strip. The distance between the upper and lower jaws now being greater than 2.54 cm (1.0 inch). This distance now becomes the new zerostrain position for the forthcoming wet test described below.

b. Wet Test—While the sample strip is still at 25 grams$_{force}$ ((+/−10 grams$_{force}$), it is wetted, starting near the upper jaws, a water/0.1% Pegosperse® ML200 (available from Lonza Inc. of Allendale, N.J.) solution [having a temperature of about 73° F.±4° F. (about 23° C.±2.2° C.)] is delivered to the sample strip via a 2 mL disposable pipette. Do not contact the sample strip with the pipette and do not damage the sample strip by using excessive squirting pressure. The solution is continuously added until the sample strip is visually determined to be completely saturated between the upper and lower jaws. At this point, the load cell is readjusted to read 0±0.5 grams$_{force}$. The sample strip is then strained at a rate of 10.16 cm/minute (4 inches/minute) and continues until the sample strip is strained past its failure point (failure point being defined as the point on the force-strain curve where the sample strip falls to 50% of its peak strength after it has been strained past its peak strength). The straining of the sample strip is initiated between 5-10 seconds after the sample is initially wetted. The initial result of the test is an array of data points in the form of load (grams$_{force}$) versus strain (where strain is calculated as the crosshead displacement (cm of jaw movement from starting point) divided by the initial separation distance (cm) between the upper and lower jaws after the pre-test.

The sample is tested in two orientations, referred to here as MD (machine direction, i.e., in the same direction as the continuously wound reel and forming fabric) and CD (cross-machine direction, i.e., 90° from MD). The MD and CD initial wet tensile strengths are determined using the above equipment and the initial total wet tensile values are calculated in the following manner:

ITWT (g/inch)=Peak Load$_{MD}$ (g$_f$)/l (inch$_{width}$)+Peak Load$_{CD}$ (g$_f$)/l (inch$_{width}$)

Basis Weight Test Method

Basis weight of a fibrous structure and/or sanitary tissue product is measured on stacks of twelve usable units using a top loading analytical balance with a resolution of ±0.001 g. The balance is protected from air drafts and other disturbances using a draft shield. A precision cutting die, measuring 3.500 in ±0.0035 in by 3.500 in ±0.0035 in is used to prepare all samples.

With a precision cutting die, cut the samples into squares. Combine the cut squares to form a stack twelve samples thick. Measure the mass of the sample stack and record the result to the nearest 0.001 g.

The Basis Weight is calculated in lbs/3000 ft$^2$ or g/m$^2$ as follows:

Basis Weight=(Mass of stack)/[(Area of 1 square in stack)×(No. of squares in stack)]

For example,

Basis Weight (lbs/3000 ft$^2$)=[[Mass of stack (g)/453.6 (g/lbs)]/[12.25 (in$^2$)/144 (in$^2$/ft$^2$)×12]]×3000 or,

Basis Weight (g/m$^2$)=Mass of stack (g)/[79.032 (cm$^2$)/10,000 (cm$^2$/m$^2$)×12]

Report result to the nearest 0.1 lbs/3000 $ft^2$ or 0.1 $g/m^2$. Sample dimensions can be changed or varied using a similar precision cutter as mentioned above, so as at least 100 square inches of sample area in stack.

Trichomes Purity Test Method

To determine the purity (lack of non-trichome materials) of the extracted trichomes, filter cakes of the extracted trichomes are formed.

Filter cakes of the extracted trichomes are made by washing the extracted trichomes in water with a liquid dishwashing detergent, for example Dawn® from The Procter & Gamble Company, and using a hand held kitchen homogenizer to completely disperse the extracted trichomes in the wash water. The wash water with the extracted trichomes is then filtered through a Buchner funnel, and washed with water and acetone and then allowed to dry on the filter paper, for example to a moisture level of less than 10% moisture, before taking images of the filter cakes.

Images of a filter cake to be analyzed is then taken using a typical flatbed scanner set at 600 dpi. ImageJ software, a free program developed by the National Institute of Health, is used to analyze the images and to count the non-trichome materials (particles) per square cm of the filter cake. The ImageJ software program is also used to calculate the total area of the non-trichome materials (particles) of the filter cake, the percent non-trichome materials (particles) of the total area, and the average particle size in units of $cm^2$ (area) of the non-trichome materials in the filter cake.

Fibrous Structure Purity Test Method

Preparation of Handsheet—

In order to test the Fibrous Structure Purity, a handsheet is prepared as follows and is then used in the test described hereinbelow.

A handsheet is a handmade specimen of a fibrous structure. Handsheets are prepared at target basis weight of 26.8 $g/m^2$, but no less than 19 $g/m^2$ and no more than 33 $g/m^2$ using the following procedure.

a. Extracted Trichomes Preparation—

A slurry of extracted trichomes is made as follows. Using an analytical balance capable of weighing to ±0.0002 g, weigh out 30 g of extracted trichomes. Record the weight of the extracted trichomes. Record the percent bone-dry extracted trichomes or consistency for this extracted trichomes. Put 500 mL of 23° C.±2° C. of City of Cincinnati, Ohio Water (or equivalent having the following properties: Total Hardness=155 mg/L as $CaCO_3$; Calcium content=33.2 mg/L; Magnesium content=17.5 mg/L; Phosphate content=0.0462) into a 2000 mL polypropylene beaker. Add the weighed extracted trichomes to the water in the beaker and let soak in the water for at least 1 hour, typically 1-2 hours (if needed, add about 10% by weight of the bone-dry extracted trichomes of "Texcare 4060"). At the end of the soaking period, transfer the contents of the beaker (water and extracted trichomes) to a disintegrator tank of a pulp disintegrator commercially available from Testing Machines, Inc. under the tradename 73-18 Pulp Disintegrator or its equivalent. Follow the manufacturer's instructions for maintaining, calibrating, and cleaning the disintegrator, as needed. The disintegrator must meet TAPPI Standard T-205. Using more of the City of Cincinnati, Ohio water (or equivalent water as described above) delivered by a polyethylene wash bottle, wash and remove any remaining extracted trichomes adhering to the beaker into the disintegrator tank. Additional City of Cincinnati, Ohio water (or equivalent water as described above) is added to the disintegrator tank to result in a total of 1500 mL of total volume in the disintegrator tank.

Next, place the disintegrator tank containing the extracted trichomes and City of Cincinnati, Ohio water (or equivalent water as described above) (23° C.±2° C.) on the distintegrator's platform and position it under the shaft and impeller blade of the disintegrator. Clamp the disintegrator tank firmly in place on the disintegrator's platform. Lower the impeller blade into position and lock in place according to the manufacturer's instructions. Put the disintegrator tank's lid in place on the disintegrator tank. Set an interval timer with timed switch outlet for exactly 10 minutes. Turn the disintegrator on and start the timer with the alarm on the timer turned on such that the alarm sounds and the disintegrator turns off automatically after exactly 10 minutes of operation. Turn the alarm off. Use the extracted trichomes slurry (extracted trichomes plus City of Cincinnati, Ohio water (or equivalent water as described above)) in the disintegrator within an hour after the completion of the 10 minutes of operation. Do not let the extracted trichomes slurry stand idle for more than an hour before using it to make the handsheets.

b. Proportioning of Extracted Trichomes—

After the extracted trichomes slurry is prepared in the disintegrator tank as described above, the extracted trichomes slurry is then proportioned in a proportioner, such as a Noble and Wood Handsheet Forming Machine or a proportioner and handsheet forming machine, which is commercially available from Adirondack Machine Corporation as follows.

To a proportioner having a 19-21 L stainless steel tank, City of Cincinnati, Ohio water (or equivalent water as described above) is added to fill the tank to about half full (about 9-10 L). The agitator of the proportioner is turned on and the speed of the agitator is adjusted to 23 rpm±2 rpm to provide good mixing once the extracted trichomes slurry is added. Good mixing can be determined by seeing that the extracted trichomes slurry is evenly mixing with the City of Cincinnati, Ohio water (or equivalent water as described above) that is added to the tank. Next, add the equivalent of 30 g of bone-dry extracted trichomes of the extracted trichomes slurry produced above to the tank. After addition of the extracted trichomes slurry to the tank, set the volume scale of the proportioner to the 19 L mark. Add additional City of Cincinnati, Ohio water (or equivalent water as described above) to make the liquid level approximately even with the top of the hook on the solution indicator pointer of the proportioner.

c. Forming Handsheet—

A handsheet is made from the extracted trichomes slurry present in the proportioner, described above, as follows.

The handsheet is made using a 12"×12" stainless steel sheet mold commercially available from Adirondack Machine Corporation. First, open the drain valve on the deckle box of the sheet mold and completely drain the deckle box. The deckle box needs to be clean and free of contaminants. Close the drain valve and open the deckle box. Turn on the water supply, City of Cincinnati, Ohio water (or equivalent water as described above) and allow the deckle box to overflow. Place a clean forming wire (84M 14"×14" polyester monofilament plastic cloth, commercially available from Appleton Wire Co.), on the coarse deckle box wire so as not to entrap any air bubbles under the forming wire. If air bubbles persist, eliminate by rubbing the wire gently with hands before closing the deckle box. Air bubbles under the forming wire, if not removed, will cause holes in the handsheet and makes the handsheet unacceptable for use in the tests described herein.

After the forming wire has been thoroughly wetted by the water, close and lock the deckle box and allow the water to rise to 8½" from the forming wire in the deckle box. A mark on the inside of the deckle box should be used to permanently indicate this volume. Add 2543 mL of the extracted trichomes slurry from the proportioner to the water in the deckle box using the proportioner sample container. Using the perforated metal deckle box plunger, distribute the extracted trichomes slurry uniformly by moving the plunger from near the top of the extracted trichomes slurry to the bottom of the extracted trichomes slurry within the deckle box and back for three complete up and down cycles. Do not touch the forming wire on the downward strokes. After the third cycle, bring the plunger up and pause for two seconds holding the plunger plate just beneath the extracted trichomes slurry surface (to eliminate wave action) and then withdraw slowly. Make sure that the extracted trichomes slurry is undisturbed in the deckle box.

Depress the switch to activate the timed opening of the drop valve of the deckle box. The drop valve will close automatically after the deckle box is completely drained. Most units completely drain in about 20-25 seconds. After the drop valve closes, open the deckle box and carefully remove the forming wire with fiber mat side up from the deckle box. Immediately place the forming wire with fiber mat side up on a vacuum box's surface (a vacuum box table) having a surface at a vacuum slot (13"×1/16" 90° flare) over which the forming wire with fiber mat passes. Keep the edge of the forming wire which is next to the operator in the same relative position during this transfer from the deckle box to the vacuum box table.

The vacuum box table's vacuum valves are set such that the low level of vacuum (pre-vacuum) peaks at 4.0±0.5" Hg and the high level vacuum peaks at 10.0±0.5" Hg according to an Ashcroft Vacuum Gauge Model 1189, range 0-15" Hg commercially available from Ashcroft Inc.

Turn on the vacuum pump (a Nash H4 Pump with a draw of 106 cfm Motor-10 HP, 1745 rpm, 3 Ph, 60 Hz available from ECM Inc.) associated with the vacuum box table. Engage the low level vacuum (pre-vacuum). Position the forming wire with the fiber mat side up on the vacuum box table so that the front edge of the forming wire (edge next to the operator) extends over the vacuum slot about ¼"-½". Pull the forming wire with fiber mat across the vacuum slot in 1±0.3 seconds at a uniform rate. The vacuum gauge should peak at 4.0±0.5" Hg. This step is referred to as the Pre-vacuum Step.

Next, turn the low level vacuum and open the high level side of the vacuum system. Place the knubby side up of a transfer wire (44M 16"×14" polyester monofilament plastic cloth commercially available from Appleton Wire Co. with the knobby side, which is the sheet side, marked with an arrow indicating the machine direction) on the vacuum box table behind the vacuum slot. The transfer wire is placed on the vacuum box table such that the 16" length is perpendicular to the vacuum slot. Carefully turn the forming wire with the fiber mat over keeping the edge of the forming wire, which has been next to the operator, in the same relative position. Gently place the forming wire with fiber mat onto the center of the transfer wire, forming a "sandwich" so that the front edge of the transfer wire (edge next to the operator) extends over the vacuum slot about ¼"-½". The direction of travel of the fiber mat over the vacuum slot must be identical to the direction of travel of the forming wire with fiber mat during the Pre-vacuum Step described above. The "sandwich" is pulled across the vacuum slot in 1±0.3 seconds at a uniform rate. The vacuum gauge should peak at 10.0±0.5" Hg. This step, which transfers the fiber mat from the forming wire to the transfer wire, is called the Transfer Vacuum Step.

Close the high level vacuum and turn off the entire vacuum system. By this time the fiber mat has become a handsheet. Next, place the "sandwich" on the vacuum box table. Separate the forming wire from the handsheet and the transfer wire by gently lifting one corner of the forming wire and removing it, leaving the handsheet attached to the transfer wire. Keep the edge of the fabric next to the operator in the same relative position as the handsheet as it was during the Transfer Vacuum Step. Make an arrow with an indelible pencil (a water color pencil commercially available from Dick Blick Art Supplies) on a corner of the handsheet to indicate the direction of travel across the vacuum slot. This identifies the handsheet's machine direction.

Next, pass the transfer wire with the handsheet attached through an E-100 Drum Dryer commercially available from Adirondack Machine Corporation with the transfer wire next to the drum dryer and with the edge that was kept next to the operator going into the drum dryer last. Pass the transfer wire with the handsheet attached through the drum dryer a second time with the handsheet next to the drum dryer.

The handsheet is removed immediately after exiting the dryer drum the second time while it is still warm.

The handsheet formed must be at a target basis weight of 26.8 g/m$^2$, but no less than 19 g/m$^2$ and no more than 33 g/m$^2$ suitable for testing. If the basis weight is less than 19 g/m$^2$ or greater than 33 g/m$^2$ then either the amount of extracted trichomes is too small or too large and the process needs to be adjusted accordingly to produce a handsheet with a target basis weight of 26.8 g/m$^2$, but no less than 19 g/m$^2$ and no more than 33 g/m$^2$.

After the handsheet is made, image the handsheet using a typical flatbed scanner set at 600 dpi. ImageJ software is used to analyze the images and to count the non-trichome materials (particles) per square cm of handsheet (fibrous structure). The ImageJ software program is also used to calculate the total area of the non-trichome materials (particles) present in the handsheet (fibrous structure), the percent non-trichome materials (particles) of the total area, and the average particle size in units of cm$^2$ (area) of the non-trichome materials in the handsheet (fibrous structure).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fibrous structure comprising a plurality of extracted trichomes, which have been passed through a pressure screen to remove non-trichome materials, such that the fibrous structure is substantially free of said non-trichome materials having an average particle size of 0.0001 $cm^2$ or greater as measured according to the Fibrous Structure Purity Test Method.

2. The fibrous structure according to claim 1 wherein the fibrous structure comprises less than 5% by weight of said non-trichome materials having an average particle size of 0.0001 $cm^2$ or greater as measured according to the Fibrous Structure Purity Test Method.

3. The fibrous structure according to claim 1 wherein the total of said non-trichome materials present in the fibrous structure exhibit a total surface area of less than 0.2% as measured according to the Fibrous Structure Purity Test Method.

4. The fibrous structure according to claim 1 wherein one or more of the individualized trichomes is derived from a plant in the *Stachys* genus.

5. The fibrous structure according to claim 1 wherein the fibrous structure exhibits a softness (PSU) increase of at least 0.5 compared to the fibrous structure without the individualized trichomes.

6. The fibrous structure according to claim 1 wherein the fibrous structure comprises less than 50% by weight on a dry fiber basis of hardwood pulp fibers.

7. The fibrous structure according to claim 1 wherein the fibrous structure comprises a softening agent.

8. The fibrous structure according to claim 1 wherein the fibrous structure is an embossed fibrous structure.

9. The fibrous structure according to claim 1 wherein the fibrous structure is a wet-molded fibrous structure.

10. A single or multi-ply sanitary tissue product comprising a fibrous structure according to claim 1.

* * * * *